United States Patent [19]

Pudney

[11] Patent Number: 4,752,011

[45] Date of Patent: Jun. 21, 1988

[54] RAIL MOUNTED CRANES

[75] Inventor: Jack L. Pudney, Mt. Eliza, Australia

[73] Assignee: M.A.N.-SWF-Elektrozug GmbH Feldkirchen, Fed. Rep of Germany

[21] Appl. No.: 27,149

[22] Filed: Mar. 16, 1987

Related U.S. Application Data

[63] Continuation of Ser. No. 762,954, Aug. 6, 1985, abandoned.

[51] Int. Cl.[4] ..... B66C 11/00

[52] U.S. Cl. ..... 212/142.1; 104/119; 212/205

[58] Field of Search ..... 212/142.1, 205, 215; 104/118, 119, 93

[56] References Cited

U.S. PATENT DOCUMENTS

| | | | |
|---|---|---|---|
| 3,152,559 | 10/1964 | Harshberger | 104/119 |
| 3,301,409 | 1/1967 | Gasperis | 212/142.001 |
| 3,319,802 | 5/1967 | Osawa | 212/142.001 |
| 3,339,753 | 9/1967 | Forster et al. | 212/205 |
| 3,902,432 | 9/1975 | Shortridge et al. . | |
| 4,150,625 | 4/1979 | Cowan | 104/119 |
| 4,423,685 | 1/1984 | Kerckhoff . | |
| 4,531,460 | 7/1985 | Pamer . | |

FOREIGN PATENT DOCUMENTS

| | | |
|---|---|---|
| 408821 | 7/1967 | Australia . |
| 441702 | 2/1970 | Australia . |
| 451280 | 6/1971 | Australia . |
| 502439 | 7/1979 | Australia . |
| 0046210 | 2/1982 | European Pat. Off. . |
| 1292348 | 11/1967 | Fed. Rep. of Germany . |
| 1531886 | 9/1969 | Fed. Rep. of Germany . |
| 2503487 | 8/1976 | Fed. Rep. of Germany . |

OTHER PUBLICATIONS

VDI-Z Journal, (Society of German Engineers), Journal 124, (1982), No. 4, pp. 135-140.

*Primary Examiner*—Joseph F. Peters, Jr.
*Assistant Examiner*—Thomas J. Brahan
*Attorney, Agent, or Firm*—Toren, McGeady & Associates

[57] ABSTRACT

A crane comprising: an elongated support structure arranged to extend generally horizontally during crane operation; a crane chassis; at least one mounting assembly mounting the chassis at least substantially on the top of the support structure for movement therealong during crane operation; and, a hoist carried by the crane chassis, the hoist extending at least substantially entirely laterally of the chassis so as to be cantilevered from the support structure. The support structure has a plate having a pair of shoulders on which the mounting assembly bears and moves along during movement of the chassis along the structure.

6 Claims, 1 Drawing Sheet

RAIL MOUNTED CRANES

Figure 1:
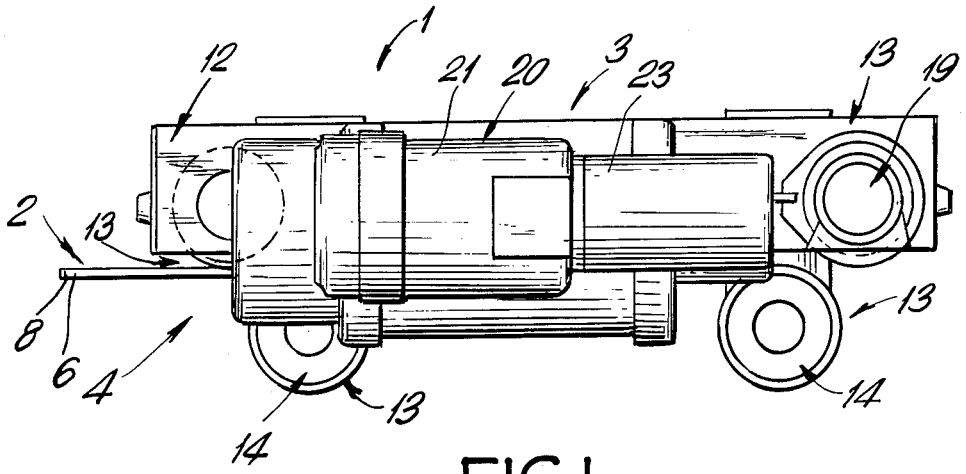

This is a continuation of application Ser. No. 762,954, filed Aug. 6, 1985, now abandoned.

This invention relates generally to a crane, and more particularly a raised rail mounted crane. The crane may be a travelling bridge beam crane suited for mounting within a building, such as a factory, and it will be convenient to hereinafter describe the invention in relation to that application. It should be appreciated, however, that the invention is not limited to that exemplary application.

Travelling bridge beam cranes are commonly used in factories to assist in transporting goods between various sections and areas within those factories. In general, these cranes usually include a support rail extending within the interior of the factory and a crane crab assembly incorporating a hoist mounted on the support rail for movement therealong. The support rail may be either rigidly suspended, or mounted on spaced apart side rails for movement therealong.

These cranes are usually located as close as possible to the roof of the factory so as to minimise encroachment into premium factory space and also to maximise the height of lift available to the hoist. In some prior cranes, an attempt to optimise that location has been made by positioning the crane crab assembly on top of the support rail adjacent the roof and that does maximise the available lift. However, that also necessitates lowering of the support rail from the roof in order to accommodate the crab assembly between the rail and factory roof and that in turn has been found to encroach significantly into factory space. Another attempt at optimum location has involved suspension of the crab assembly from the main rail, but that simply allows raising of the support rail at the expense of available hoist lift. Another alternative may be the positioning of the crane crab assembly on a side of the support rail so that it extends laterally therefrom. However, resultant stresses placed on the support rail during crane use necessitate substantial reinforcement of the rail and its support arrangement, adding to the overall crane bulk which can again encroach into factory space.

Thus, prior cranes have not been entirely satisfactory in their manner of location within factories, and it is an object of the present invention to provide a crane or overhead travelling crane which is capable of alleviating this difficulty.

With that in mind, the present invention provides a crane, including: an elongated support structure arranged to extend generally horizontally during crane operation; a crane chassis; at least one mounting assembly mounting the chassis at least substantially on top of the support structure for movement therealong during crane operation; and, a hoist carried by the crane chassis, the hoist extending at least substantially entirely laterally of the chassis so as to be cantilevered from the support structure.

Preferably, the support structure has at least one shoulder on which the or a respective mounting assembly bears and moves along during movement of the chassis along the structure. The or each bearing shoulder preferably extends at least substantially entirely along the support structure. In addition, the or each bearing shoulder is preferably located so that the or each mounting assembly bearing thereon reacts with the shoulder(s) in response to loads applied to the hoist in order to maintain the chassis on the support structure. Preferably, it is solely this reaction between the or each mounting assembly and the or each bearing shoulder which prevents the crane chassis from twisting about a longitudinal axis of the support structure and thus off that structure under this loading.

Preferably, the support structure is a support rail. That rail is preferably of a substantial and rigid construction to facilitate absorption of stresses applied as a result of hoist loading.

Preferably, the crane chassis generally overlies the support structure so that it moves along the top of that structure during crane operation. However, preferably, that chassis extends a height above the support structure which is small compared to an overall height of that support structure. Thus, projection of the chassis above the support structure is minimised. The chassis is also preferably of a substantial and rigid construction to assist in the absorption of stresses applied through hoist loading.

Preferably, a plurality of mounting assemblies are provided and they are mounted on the chassis. Each mounting assembly preferably includes at least one rolling member in rolling contact with a respective bearing shoulder and along which that member rolls to move the chassis along the support structure. Preferably, the mounting assemblies also act to guide the chassis along the support structure and thereby minimise relative lateral movement.

Preferably, the hoist is mounted on the crane chassis and, because it extends laterally therefrom, is positioned generally immediately above and laterally outwardly of the support structure. Preferably, the hoist is constructed so that it does not extend above the crane chassis, but at the same time, generally does not extend below that chassis. In this way, in its example application, the entire crane can be located very close to the factory roof to minimise factory space intrusion and to maximise available hoist lift.

The following description refers to a preferred embodiment of the various features of the crane of the present invention. To facilitate an understanding of the invention, reference is made in the description to the accompanying drawings where the crane is illustrated in that preferred embodiment. It is to be understood that the crane of the present invention is not limited to the preferred embodiment as hereinafter described and illustrated in the drawings.

Figure 2:
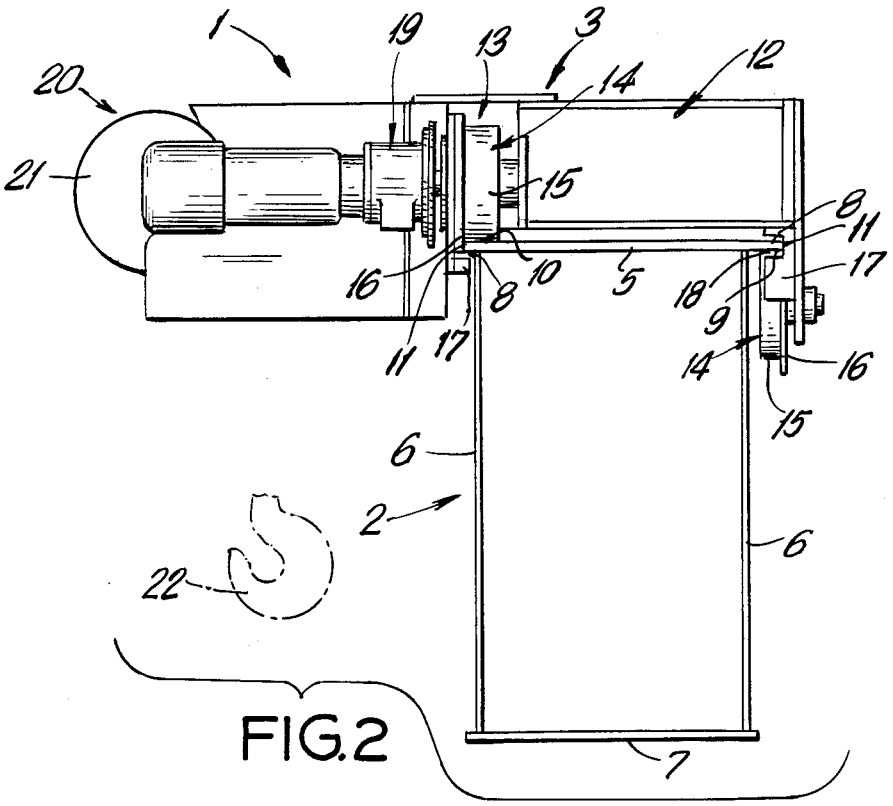

In the drawings:

FIG. 1 is a side elevation of a preferred embodiment of a crane of the present invention; and, FIG. 2 is an end elevation of the crane of FIG. 1.

Referring to the drawings there is generally shown crane 1, including support rail 2, intended to extend generally horizontally during crane operation and crane crab assembly 3, mounted on support rail 2, for movement therealong. Although not shown, support rail 2, may be either rigidly suspended at its ends or mounted at those ends on spaced apart side rails for movement therealong as will be well recognised by those skilled in this art.

Support rail 2, is of a unitary and rigid construction and includes rail body 4, which may be generally rectangular shaped and so have top wall 5, side walls 6, and bottom wall 7. Body 4, may be hollow in the nature of a box beam as shown. Support rail 2, also has a pair of spaced apart support flanges 8, projecting laterally from side walls 6, and extending along and forming continuations of top wall 5. Flanges 8, define oppositely facing bearing shoulders 9,10, that extend at least substantially entirely along flanges 8, and laterally thereof to terminal edges 11.

Crane crab assembly 3, includes crane chassis 12, overlying support rail 2, so that it will move along top wall 5, during crane operation. Chassis 12, is generally rectangular shaped and may also be hollow in the nature of a short box beam.

Crane crab assembly 3, also includes a plurality of mounting assemblies 13, on chassis 12, for moving chassis 12, along support rail 2, during crane operation. As shown, four such assemblies 13, may be provided, a pair associated with each of support flanges 8. Assemblies 13, of each pair are spaced apart with the wheel assembly pair associated with bearing shoulder 10, being located outwardly of the other wheel assembly pair relative to the longitudinal extent of support rail 2. In addition, chassis 12, together with mounting assemblies 13, effectively straddle support rail 2.

Each mounting assembly 13, includes rolling wheel 14, rotatably mounted on crane chassis 12. Each wheel 14, has tread portion 15, in rolling contact with a respective one of bearing shoulders 9,10, and flange portion 16, extending radially from tread portion 15, and in contact with terminal edge 11, of respective bearing shoulder 9,10. Thus, in crane operation, tread portions 15, bear upon and roll along respective bearing shoulders 9,10, to move chassis 12, along support rail 2, while flange portions 16, bear against terminal edges 11, to guide chassis 12, therealong.

Crane crab assembly 3, may be retained on support rail 2, solely by action of its own weight and any crane load during operation causing a reaction between bearing shoulders 9,10, and mounting assemblies 13. However, retention of chassis 12, may be assisted particularly between crane operations by the inclusion of keeper plate 17, in at least one of mounting assemblies 13. Each mounting assembly 13, may be provided with a keeper plate 17, mounted on chassis 12, and having recess 18, formed therein to receive a respective flange 8. Thus, flanges 8, are partially captured by plates 17, thereby preventing movement of chassis 12, away from support rail 2. One or more of keeper plates 17, may be releasably mounted on chassis 12, to allow removal of that chassis 12, from support rail 2, such as for maintenance purposes.

At least one mounting assembly 13, is provided with drive means such as drive motor 19, for rotatably driving wheel 14, of that assembly 13, and thus moving chassis 12, along support rail 2. That drive motor 19, may be an electrical, helical gear motor operatively coupled to wheel 14.

Crane crab assembly 3, further includes hoist 20, carried by crane chassis 12. Hoist 20, is mounted on crane chassis 12, so as to extend substantially entirely laterally thereof and neither above nor below the level of that chassis 12. Hoist 20, may be of any suitable construction and configuration. In that regard, hoist 20, may include suitable winch assembly 21, having a rotatable cable drum (not shown) to which a goods cable (not shown) is attached and about which that cable can be wound. Hook 22, or other connection device may be provided on that cable for connection to goods to be moved by crane 1. Hoist 20, may also include suitable drive means such as drive motor 23, coupled to winch assmebly 21, for rotation of same. Winch assembly 21, and drive motor 23, are located in substantially the same plane extending laterally from support rail 2.

Crane 1, of the present invention may be constructed from any suitable material using any suitable manufacturing process. In that regard, crane 1, may be generally fabricated from metal bar stock and standard engineering components.

Installation and operation of a crane according to the present invention is conveniently the same as prior rail mounted cranes. However, the crane of the present invention provides an advantage of being mountable in a building such as a factory with minimal sacrifice to valuable space and also to the lifting head of the hoist of the crane. In that regard, the rail of the crane can be positioned almost very close to the roof of the building and that will position the hoist also very close to that roof and so maximise hoist lift.

The crane of the present invention is relatively simple in both construction and operation. Of particular significance is that the crane does not require specialised installation or operation procedures when compared to prior cranes. As such, costs of production, installation, operation and maintenance are likely to be minimal.

Finally, it should be understood that various modifications and/or alterations may be made without departing from the ambit of the present invention as defined in the claims appended hereto.

I claim:

1. Single beam overhead travelling crane comprising an elongated box girder shaped rail body (4) extending substantially horizontally and including a horizontally arranged top wall (5), a horizontally arranged bottom wall (7) spaced downwardly from said top wall, and a pair of laterally spaced upwardly extending side walls (6) extending between said top wall and bottom wall, said pair of side walls comprising a first side wall and a second side wall, said top wall (5) is a unitary plate member and extends horizontally laterally outwardly beyond each of said first and second side walls (6) and forms a pair of outwardly projecting horizontally arranged support flanges (8) extending in the elongated direction of said rail body (4), said pair of support flanges comprises a first support flange projecting outwardly from said first side wall and a second support flange projecting outwardly from said second side wall, said first support flange (8) forming an upwardly facing first bearing shoulder (10) and said second support flange forming a downwardly facing second bearing shoulder (9), each of said first and second bearing shoulders having an upwardly extending laterally outer terminal edge (11) forming an outer edge of said top wall, a crane chassis (12) positioned directly above said top wall (5), a plurality of rolling wheels (14) with horizontally arranged axes mounted on said crane chassis (12) and each said rolling wheel having an annular bearing surface (15) encircling and spaced radially outwardly from the horizontal axis thereof, a first said rolling wheel (14) located above and supported directly on said upwardly facing first bearing shoulder (10) of said top wall and a second said rolling wheel (14) located below and bearing directly against said downwardly facing second bearing shoulder (9) of said top wall, each of said first and second rolling wheels (14) being load bearing and guide wheels and having an annular flange portion (16) extending outwardly from said bearing surface (15) thereof transversely of the horizontal axis whereby said flange portions (16) bear directly against said corresponding said terminal edge and guide said chassis (12) along the terminal edges (11) of said bearing shoulders (9, 10), and a hoist (20) located laterally outwardly from said chassis and positioned laterally outwardly from said first side wall of said rail body (4) on the opposite side from said second side wall.

2. A crane as claimed in claim 1, wherein at least one keeper member (17) is mounted on said chassis (12) above said top wall (5) and is arranged to extend downwardly about one of said first and second bearing shoulders (9, 10) and to project inwardly below the one of said first and second shoulders to facilitate retention of the chassis on the rail body (4).

3. A crane as claimed in claim 2, wherein the keeper member (17) is a keeper plate (17) having a recess formed therein facing toward said terminal edge (11) of the one of said first and second shoulders and arranged to receive therein a horizontally extending portion of the respective bearing shoulder (9, 10).

4. A crane as claimed in claim 1, wherein the crane chassis (12) is supported on said rail body (4) so that it moves along the top wall (5) of said rail body during crane operation.

5. A crane as claimed in claim 1 or 4, wherein the chassis (12) extends a height above said rail body (4) which is small compared to an overall height of said rail body.

6. A crane as claimed in claim 1, wherein the hoist (20) is located wholly within the vertical range of said chassis so that it generally extends neither above nor below the level of the chassis, but only laterally therefrom.

* * * * *